US005347956A

United States Patent [19]

Hughes

[11] Patent Number: 5,347,956

[45] Date of Patent: Sep. 20, 1994

[54] WATER HEATER WITH INTEGRAL MIXING VALVE

[75] Inventor: Dennis R. Hughes, Germantown, Wis.

[73] Assignee: AOS Holding Company, Milwaukee, Wis.

[21] Appl. No.: 57,726

[22] Filed: May 5, 1993

[51] Int. Cl.[5] ..... F22B 5/00

[52] U.S. Cl. ..... 122/13.1; 122/14; 236/12.21; 236/12.22

[58] Field of Search ..... 126/361; 122/13.1, 14, 122/17; 236/12.21, 12.22

[56] References Cited

U.S. PATENT DOCUMENTS

| | | | |
|---|---|---|---|
| 1,166,531 | 1/1916 | Lovekin . | |
| 1,694,492 | 12/1928 | Tabler . | |
| 1,697,621 | 1/1929 | Twigg . | |
| 1,734,920 | 11/1929 | Shuell . | |
| 2,017,668 | 10/1935 | Meagher | 122/504 |
| 2,113,896 | 4/1938 | Moloney | 257/138 |
| 2,283,513 | 5/1942 | Smith | 137/21 |
| 2,431,110 | 11/1947 | Clair | 122/504.1 |
| 2,892,465 | 6/1959 | Lyle | 137/216 |
| 2,923,797 | 2/1960 | Thelen | 200/137 |
| 3,063,432 | 11/1962 | Bond | 122/504 |
| 3,065,764 | 11/1962 | Lyle | 137/337 |
| 3,154,248 | 10/1964 | Fulton | 236/21 |
| 3,190,284 | 6/1965 | Koepf | 126/362 |
| 3,317,706 | 5/1967 | Fischer | 219/312 |
| 3,447,560 | 6/1969 | Dobson | 137/337 |
| 3,913,830 | 10/1975 | King | 236/12.22 |
| 3,961,156 | 6/1976 | Patton | 219/331 |
| 4,242,569 | 12/1980 | Kayser | 219/314 |
| 4,305,547 | 12/1981 | Cohen | 236/18 |
| 4,680,446 | 7/1987 | Post | 219/312 |
| 4,827,962 | 5/1989 | Picton | 137/74 |
| 4,930,551 | 6/1990 | Haws | 137/337 |

FOREIGN PATENT DOCUMENTS

| | | | |
|---|---|---|---|
| WO9004141 | 4/1990 | PCT Int'l Appl. | F24H 9/12 |

*Primary Examiner*—Carroll B. Dority

*Attorney, Agent, or Firm*—James Earl Lowe, Jr.; David R. Price

[57] ABSTRACT

A water heater comprising a tank adapted to hold water, a water outlet communicating with the tank, a water inlet communicating with the tank and communicable with the outlet independently of the tank, and a temperature responsive valve in the tank for permitting unrestricted communication of heated water in the tank with the water outlet when the water temperature in the tank is below a predetermined value, and for restricting communication of heated water in the tank with the water outlet when the water temperature in the tank is above the predetermined value.

17 Claims, 2 Drawing Sheets

WATER HEATER WITH INTEGRAL MIXING VALVE

BACKGROUND OF TIME INVENTION

The invention relates to water heaters, and more particularly to water heaters including arrangements for reducing or limiting the temperature of the outgoing hot water.

It is known to provide in a water heater a plug having a cold water inlet and a hot water outlet. The cold water inlet is typically connected to a dip tube which extends to the bottom of the water tank. The hot water outlet delivers hot water from the tank to a network of pipes for delivery to a tap or taps usually in coordination with a parallel network of pipes that deliver cold water to the tap or taps. In the conventional water heater, the cold water inlet and hot water outlet are completely independent except for communication with the tank.

It is also known in the art to provide a mixing valve connected between the cold water inlet pipe and the hot water outlet pipe remote from or immediately adjacent the water heater. Such a valve includes a thermostatic device operable to detect the temperature of the water in the hot water pipe and to introduce cold water into the hot water pipe when the hot water temperature is too high, thereby reducing the temperature of the hot water delivered and the attendant risk of scalding someone using the hot water tap.

SUMMARY OF THE INVENTION

The invention provides a water heater including a tank, an opening in the top wall of the tank, and a plug threaded into the opening. The plug seals the opening and defines a cold water inlet passage, a hot water outlet passage communicating with the tank via an intake port, and a by-pass passage connecting the cold water inlet passage with the hot water outlet passage. A temperature responsive mixing valve is housed in the plug and in the tank.

When the water temperature in the tank is below a first predetermined value, the temperature responsive valve completely opens the intake port and completely closes the by-pass passage, so that only water from the tank flows out through the hot water outlet passage. As the water temperature in the tank increases from the first predetermined value to a second predetermined value, the valve gradually closes the intake port and gradually opens the by-pass passage, so that a mixture of hot water from the tank and cold water from the inlet passage flows out through the hot water outlet passage. When the water temperature in the tank is above the second predetermined value, the valve completely closes the intake port and completely opens the by-pass passage, so that only cold water from the inlet passage flows out through the hot water outlet passage.

A principal advantage of the invention is to provide a water heater wherein the mixing valve is integrated into the water heater, thereby providing a water heater and mixing valve combination that is easily and inexpensively manufactured and installed. By locating the valve inside the tank, material strength and seal requirements are reduced because internal and external pressures are equalized. Installation costs are reduced because an external valve, additional piping and labor are eliminated.

Another principal advantage of the invention is the avoidance of the high temperature water spike that can occur during a water draw with an externally mounted mixing valve. The spike occurs because of the time necessary for the external valve to react from ambient temperature to the hot and cold incoming water temperatures. The integral valve of the invention needs no time to react because it is already at tank water temperature.

Other features and advantages of the invention will become apparent to those skilled in the art upon review of the following detailed description, claims and drawings.

Figure 1:
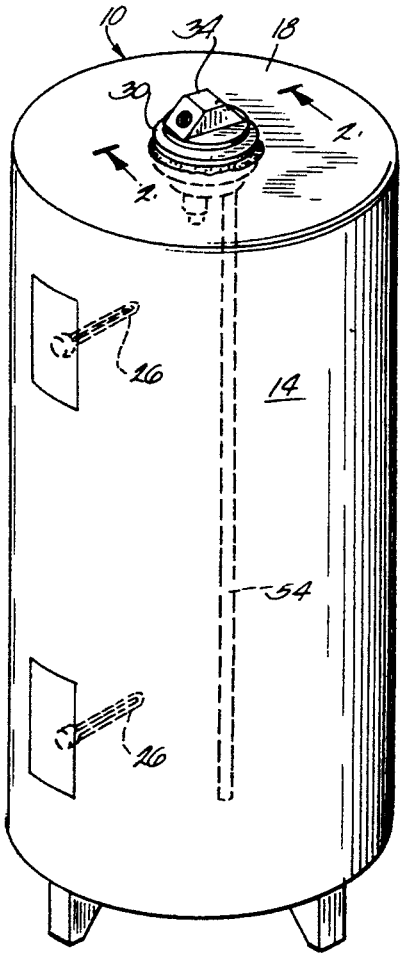
FIG. 1 is a perspective view of a water heater embodying the invention.

Before one embodiment of the invention is explained in detail, it is to be understood that the invention is not limited in its application to the details of the construction and the arrangements of components set forth in the following description or illustrated in the drawings. The invention is capable other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

Figure 2:
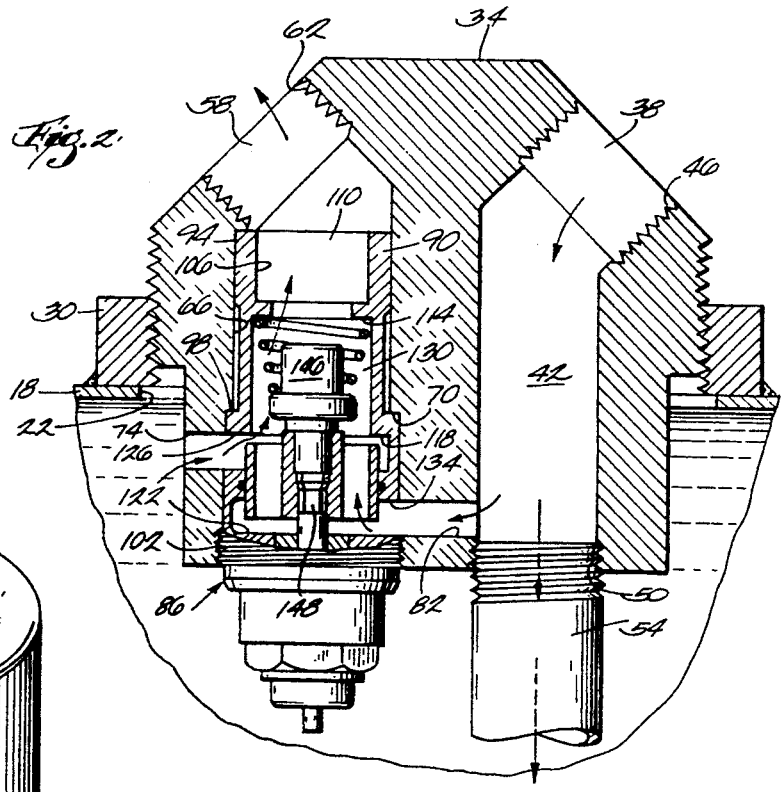
FIG. 2 is an enlarged view of the plug and the mixing valve taken along line 2—2 in FIG. 1 and showing the hot water passage partially closed and the by-pass passage partially open.

Illustrated in the drawings is a water heater 10 embodying the invention. As shown in FIG. 1, the water heater 10 comprises a tank 14 for holding water. The tank 14 includes a top wall 18 having therein an opening 22 (FIG. 2). A pair of vertically spaced heating elements 26 (FIG. 1) extend horizontally into the tank 14 to heat the contents of the tank 14. An internally threaded collar 30 is mounted on the top wall 18 and is aligned with the opening 22. The collar 30 is preferably welded to the top wall 18. A plug 34 having a top and a bottom is threaded into the collar 30 and extends through the opening so that the top of the plug 34 is outside the tank 14 while the bottom is inside the tank 14.

Referring now to FIG. 2, the plug 34 defines a cold water inlet passage 38 and a cold water passage 42 connecting the cold water inlet passage 38 to the tank 14. The outer end of the cold water inlet passage 38 defines an inlet port 46. The cold water inlet passage 38 is internally threaded for connection to a pipe (not shown) which delivers water to the water heater 10. The cold water passage 42 extends vertically from the lower end of the cold water inlet passage 38 to the bottom of the plug 34 to define a dip tube port 50. A conventional dip tube 54 is threaded into the dip tube port 50 and extends to the bottom of the tank 14 to deliver cold water directly to the lower portion of the tank 14.

The plug 34 further defines a hot water outlet passage 58. The hot water outlet passage 58 exits the top of the plug 34 and, like the cold water inlet passage 38, is internally threaded to allow connection to a hot water delivery pipe (not shown). The outer end of the hot water outlet passage 58 defines an outlet port 62.

The plug 34 further defines a passageway 66 which extends vertically from the lower end of the hot water outlet passage 58 to the bottom of the plug 34 where the passageway 66 is internally threaded. The passageway 66 includes an annular passageway shoulder 70. An intake port 74 below the passageway shoulder 70 extends horizontally from the tank 14 to the passageway 66. During "normal" operation, the intake port 74 provides a pathway for hot water from the tank 14 to flow into the passageway 66.

The plug 34 also defines a horizontally extending by-pass passage 82 connecting the cold water passage 42 to the passageway 66 at a point below the intake port 74. In other embodiments (not shown), the by-pass passage 82 can connect the cold water passage 42 to the passageway 66 above the valve housing 90 near the water outlet 58.

Valve means is provided for controlling the temperature of the temperature of hot water flowing out of the water heater 10 through the hot water outlet. The valve means is responsive to the temperature of the water in the tank 14. In the preferred form of the invention, the valve means is a mixing valve 86 located in the plug 34 and in the tank 14.

The mixing valve 86 includes a longitudinally extending, generally cylindrical valve housing 90. The valve housing 90 has a generally cylindrical outer surface 94 which includes an annular valve housing shoulder 98 and an externally threaded portion 102. The valve housing 90 is threaded into the lower end of the passageway 66 to bring the valve housing shoulder 98 in contact with the passageway shoulder 70 to secure the housing 90 within the passageway 66.

The housing 90 also includes a generally cylindrical inner housing surface 106 defining a longitudinally extending central passage 110. The inner housing surface 106 includes an annular upper shoulder 114, an annular middle shoulder 118, and an annular lower shoulder 122, the purpose of which will be described in greater detail below.

The housing 90 also defines a hot water port 126 communicating with the intake port 74. The hot water port 126 provides a pathway for water to flow from the intake port 74 to the central passage 110 of the mixing valve 86. Together, the intake port 74, the hot water port 126, the central passage 110 and the passageway 66 form a hot water passage 130 communicating between the tank 14 and the hot water outlet passage 58.

The housing also defines a by-pass port 134 which connects the by-pass passage 82 to the central passage 110 of the mixing valve 86. The cold water passage 42, the by-pass passage 82, the by-pass port 134, the central passage 110 and the passageway 66 allow cold water to flow from the cold water inlet passage 38 to the hot water outlet passage 58 as will be described hereinafter.

Figure 3:
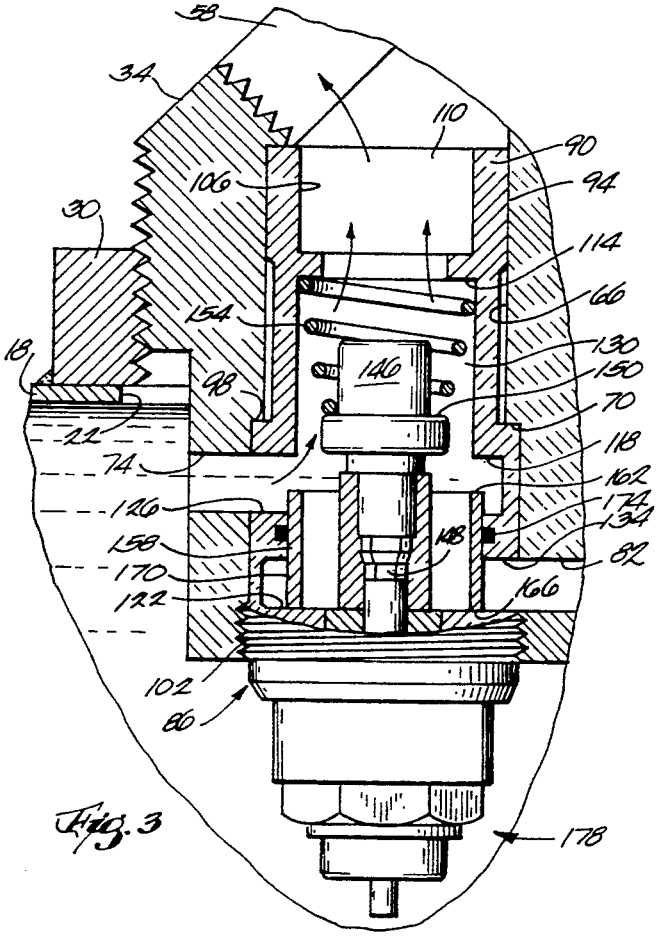
FIG. 3 is an enlarged, partial view of the plug and mixing valve showing the by-pass passage completely closed and the hot water passage completely open.

Referring now to FIG. 3, the mixing valve 86 further includes a temperature-sensitive device including a valve stem 146 extending vertically within the central passage 110 of the valve housing 90. As is known in the art, a plunger 148 extends downwardly from the valve stem 146. The distance the plunger 148 extends from the valve stem 146 increases as the temperature of the valve stem 146 increases. The lower end of the plunger 148 bears against the lower end of the housing 90 so that the valve stem 146 moves upwardly in the housing 90 as the temperature of the valve stem increases. The upper portion of the valve stem 146 includes an annular valve stem shoulder 150. A helical spring 154 extends between the valve stem shoulder 150 and the upper shoulder 114 of the valve housing 90 so as to bias the valve stem 146 downwardly to a lower or resting state position (shown in FIG. 3). The valve stem 146 is also movable from its resting state position to a second or upper position (shown in FIG. 4).

Still referring to FIG. 3, the mixing valve 86 also includes a sleeve-like cylindrical valve member 158 moveable with the valve stem 146 and connected thereto by a series of spokes (not shown) extending radially from the valve stem 146 to the valve member 158. The spaces between the spokes define a plurality of water conduits communicating between the upper and lower ends of the valve member 158. The valve member 158 includes an upper valve surface 162, a lower valve surface 166, and a cylindrical outer surface 170 extending between the upper valve surface 162 and the lower valve surface 166. An O-ring 174 seated in a recess in the valve housing inner surface 106 seals the interface between the outer surface 170 and the valve housing 90. The O-ring 174 is positioned above the by-pass port 134, but below the hot water intake port 74.

Figure 4:
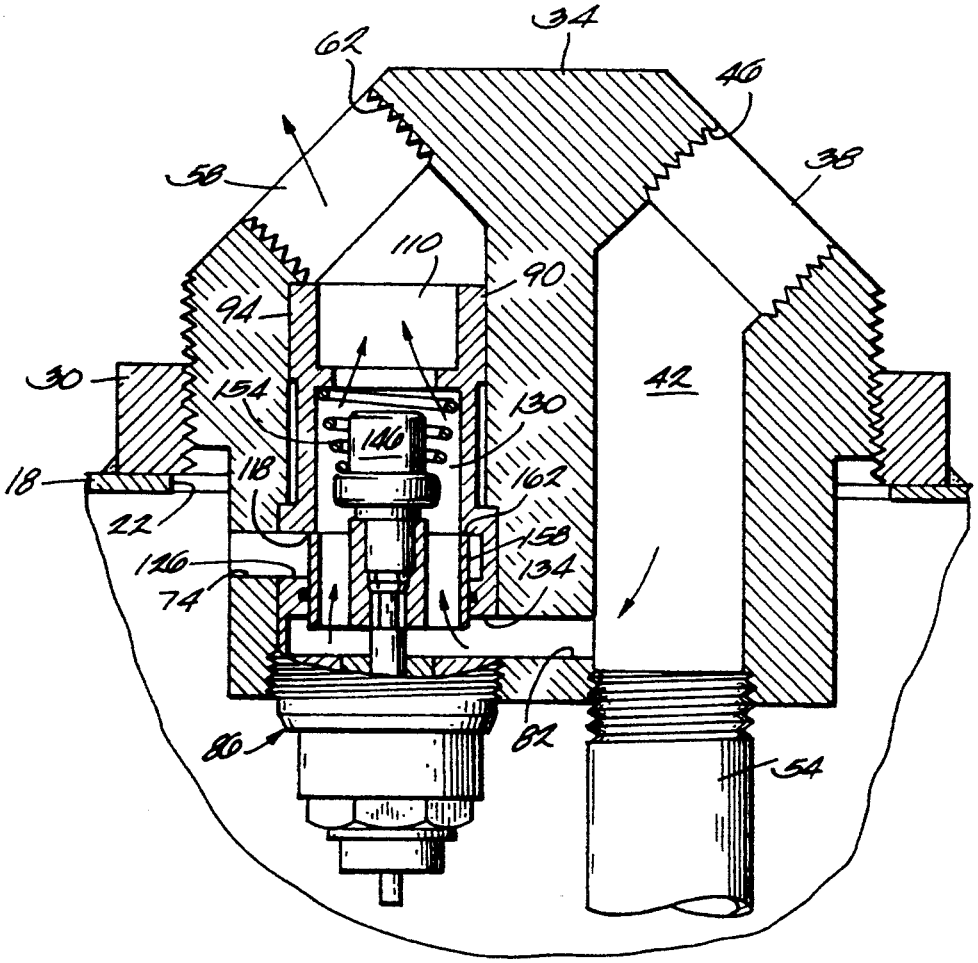
FIG. 4 is a view similar to that of FIG. 2 showing the by-pass passage completely open and the hot water passage completely closed.

When the valve stem 146 is in its lower position, as shown in FIG. 3, the lower valve surface 166 sealingly abuts the lower shoulder 122 of the valve housing 90, the by-pass port 134 is closed, and the hot water port 126 communicates with the central passage 110. Hot water is free to flow from the hot water port 126 to the hot water outlet passage 58 via the central passage 110. When the valve stem 146 is in its upper position, as shown in FIG. 4, the upper valve surface 162 sealingly abuts the middle shoulder 118 of the valve housing 90, the by-pass port 134 is open, and the hot water port 126 is closed. Cold water is free to flow from the by-pass port 134 to the central passage 110 and then to the hot water outlet passage 58 via the water conduits extending through the valve member 158.

The mixing valve 86 also includes temperature adjustment means 178 for adjusting to a predetermined value the tank water temperature at which the valve is responsive. Such an arrangement is known in the art and will not be described in greater detail.

When the temperature of the water in the tank 14 is below a first predetermined value, the mixing valve 86 is in a resting state. The valve stem 146 and the valve member 158 are biased to the lower position, preventing the flow of water from the by-pass passage 82 through the by-pass port 134 and into the central passage 110 of the mixing valve 86. Concurrently, the pathway from the hot water tank 14 through the intake port 74 and the hot water port 126 is completely unrestricted. Accordingly, hot water can flow as needed from the tank 14 into the hot water passage 130 for delivery to the plumbing system.

As the water in the tank 14 is heated and the temperature rises above the first predetermined value, the valve stem 146 and the valve member 158 gradually move upwardly. Gradual upward movement of the valve member 158 increasingly restricts the flow of hot water from the tank 14 as the upper valve surface 162 moves toward the middle shoulder 118 of the valve housing 90. At the same time, the upward movement of the valve member 158 separates the lower valve surface 166 from the lower shoulder 122, thereby opening the by-pass port 134 to allow water flow from the cold water passage 42 through the by-pass passage 82 and into the central passage 110 of the mixing valve 86. This causes cold water to flow into the hot water passage 130 to mix with and reduce the temperature of water flowing into the hot water passage 130 via the intake port 74. Thus, as the tank water temperature increases from the first predetermined value, the amount of water flowing through the hot water outlet passage 58 from the tank 14 decreases and the amount from the cold water inlet passage 38 increases.

When the water temperature in the tank 14 reaches a second predetermined value, the valve stem 146 reaches its maximum point of vertical travel or its upper position. At this point, the upper valve surface 162 is in register with the middle shoulder 118 of the valve housing 90. Accordingly, the flow of hot water through the hot water port 126 is completely prevented. The mixing valve 86 thus substantially prevents the flow of potentially scalding hot water through the piping system to the tap. The by-pass passage 82 is now completely open so that cold water from the cold water passage 42 may pass unrestricted through the by-pass passage 82 and the by-pass port 134 and into the hot water passage 130. Because there is no water flowing out of the tank 14, there is also no water flowing into the tank 14 and, accordingly, a water pressure gradient exists between the cold water inlet port 46 and the hot water outlet port 62. This water pressure gradient causes cold water to flow through the by-pass passage 82, the by-pass port 134, the central passage 110, the hot water outlet passage 58 and the hot water outlet port 62. Thus, when the tank 14 water temperature is above the second predetermined value, only cold water flows out of the water heater 10 via the hot water outlet passage 58.

Various features of the invention are set forth in the following claims.

I claim:

1. A water heater comprising a tank adapted to hold water, means forming a water outlet communicating with said tank, means forming a water inlet communicating with said tank and communicable with said outlet independently of said tank, heating means for heating water in said tank, and temperature responsive means in said tank for permitting unrestricted communication of heated water in said tank with said water outlet when the water temperature in said tank is below a predetermined value, and for restricting communication of heated water in said tank with said water outlet and providing communication of said inlet with said outlet independently of said tank when the water temperature in said tank is above said predetermined value.

2. A water heater in accordance with claim 1 wherein said temperature responsive means prevents communication of heated water in said tank with said water outlet when the water temperature in said tank is above a second predetermined value.

3. A water heater in accordance with claim 1 wherein said temperature responsive means variably restricts communication of heated water in said tank with said water outlet when the water temperature in said tank is above said predetermined value.

4. A water heater in accordance with claim 3 wherein said temperature responsive means prevents communication of heated water in said tank with said water outlet when the water in said tank is above a second predetermined value.

5. A water heater in accordance with claim 1 and further including an opening in said tank, and wherein said temperature responsive means includes plug means threadably received in said opening and defining said water inlet and said water outlet.

6. A water heater in accordance with claim 5 wherein said temperature responsive means selectively varies communication of said water inlet with said water outlet when the water temperature in said tank is above said predetermined value.

7. A water heater in accordance with claim 6 wherein said temperature responsive means prevents communication between said tank and said water outlet when the water temperature in said tank is above a second predetermined value.

8. A water heater in accordance with claim 1 wherein said temperature responsive means includes temperature adjustment means for adjusting the predetermined temperature value at which said means is responsive.

9. A water heater comprising a tank;

a hot water passage communicating with said tank;

a cold water passage communicating with said tank;

means forming a by-pass passage for providing communication between said cold water passage and said hot water passage; and temperature responsive valve means in said tank for restricting water flow through said hot water passage when the water temperature in said tank is above a predetermined value and for allowing water flow through said by-pass passage when the water temperature in said tank is above said predetermined value so that cold water from said cold water passage and hot water from said tank are mixed to reduce the temperature of water exiting said water heater through said hot water passage.

10. A water heater in accordance with claim 9, and further including an opening in said tank, and plug means threadably received in said opening and defining said hot water passage, said cold water passage, said by-pass passage, and said temperature responsive valve means.

11. A water heater in accordance with claim 10 wherein said temperature responsive valve means variably restricts the flow of heated water through said hot water passage when the water temperature in said tank is above said predetermined value.

12. A water heater in accordance with claim 11 wherein said temperature responsive valve means prevents the flow of heated water through said hot water passage when the water temperature in said tank is above a second predetermined value.

13. A water heater in accordance with claim 12 wherein said temperature responsive valve means closes said by-pass passage when the water temperature in said tank is below said first predetermined value.

14. A water heater in accordance with claim 13 wherein said temperature responsive valve means varies water flow through said by-pass passage when the water temperature in said tank is above said first predetermined value and below said second predetermined value.

15. A water heater in accordance with claim 14 wherein said temperature responsive valve means includes temperature adjustment means for adjusting the predetermined temperature value at which said means is responsive.

16. A water heater comprising a tank having therein an opening;

a plug in said opening, said plug including a water outlet port, an intake port communicating with said tank, a hot water passage communicating between said intake port and said water outlet port, a water inlet port, a cold water passage communicating between said water inlet port and said tank, and a by-pass passage communicating between said cold water passage and said hot water passage; and temperature responsive valve means in said plug and in said tank for opening said intake port and closing said by-pass passage when the water temperature in said tank is below a first predetermined value, for opening said intake port and said by-pass passage when the water temperature in said tank is above said first predetermined value and below a second predetermined value, and for closing said intake port and opening said by-pass passage when the temperature in said tank is above said second predetermined value.

17. A water heater in accordance with claim 16 wherein said temperature responsive valve means decreases water flow through said intake port to said hot water passage as the water temperature in said tank increases from said first predetermined value to said second predetermined value and increases water flow through said by-pass passage as the water temperature in said tank increases from said first predetermined value to said second predetermined value.

* * * * *